United States Patent [19]

Gehrung et al.

[11] Patent Number: 4,514,937

[45] Date of Patent: May 7, 1985

[54] METHOD FOR THE SURFACE TREATMENT OF MAGNETIC RECORDING MEDIA

[75] Inventors: Manfred Gehrung, Grossniedesheim; Klaus Schoettle, Heidelberg; Helmut Kreissler, Oberkirch; Peter Rudolf, Fussgoenheim; Joachim Hack, Ludwigshafen; Friedrich Anslinger, Freinsheim, all of Fed. Rep. of Germany

[73] Assignee: BASF Aktiengesellschaft, Fed. Rep. of Germany

[21] Appl. No.: 339,504

[22] Filed: Jan. 15, 1982

[30] Foreign Application Priority Data

Feb. 5, 1981 [DE] Fed. Rep. of Germany ..... 3103874

[51] Int. Cl.[3] ..... B24B 1/00

[52] U.S. Cl. ..... 51/281 SF; 51/145 R; 51/154; 51/328; 51/58

[58] Field of Search ..... 51/139, 138, 142, 145, 51/328, 58, 62, 67, 68, 154

[56] References Cited

U.S. PATENT DOCUMENTS

| | | | |
|---|---|---|---|
| 2,895,263 | 7/1959 | Reynolds | 51/139 |
| 3,415,017 | 12/1968 | Murray | 51/139 X |
| 3,524,285 | 8/1970 | Rutt | 51/139 X |
| 3,541,735 | 11/1970 | Schaller | 51/142 |
| 3,909,986 | 10/1975 | Miyazawa | 51/138 |
| 3,943,666 | 3/1976 | Dion et al. . | |
| 4,254,585 | 3/1981 | Schoettle et al. . | |
| 4,347,689 | 9/1982 | Hammond | 51/145 R |

*Primary Examiner*—Harold D. Whitehead
*Attorney, Agent, or Firm*—Keil & Weinkauf

[57] ABSTRACT

A method and apparatus for burnishing the surface of magnetic recording media, wherein there is relative movement between the surface to be burnished and the abrasive member, and the abrasive member is urged against the said surface, the pressure applied being increased over a period of time or at a plurality of locations, and then being reduced again.

4 Claims, 4 Drawing Figures

A-A

I-I

METHOD FOR THE SURFACE TREATMENT OF MAGNETIC RECORDING MEDIA

Figure 1:
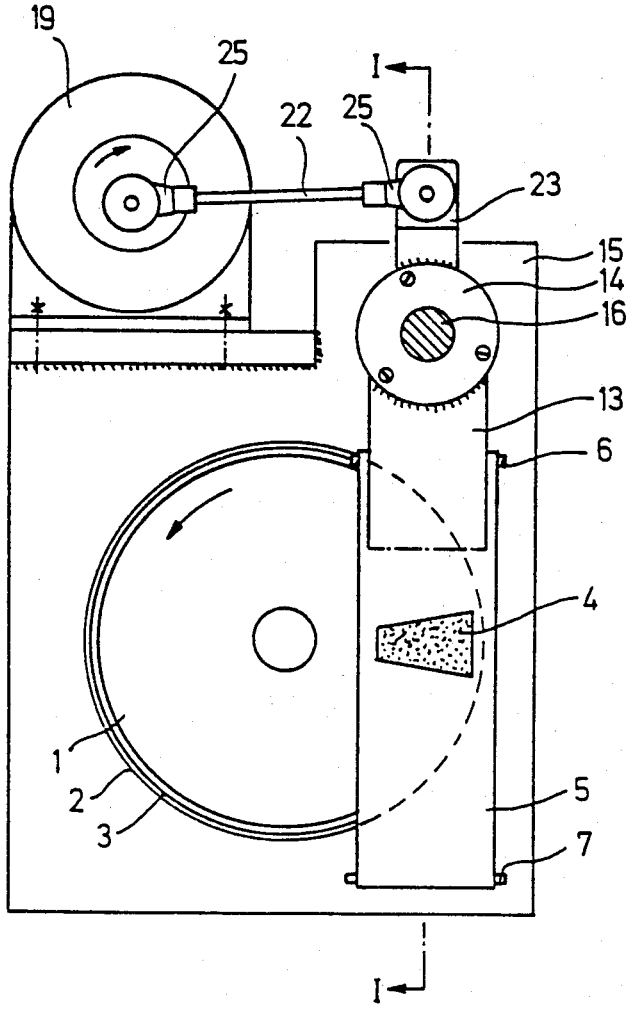

The present invention relates to a method of treating the surface of magnetic recording media by burnishing, in which there is relative movement between the surface to be treated and the abrasive member, and the abrasive member is pressed against the said surface. The invention also relates to apparatus for carrying out the novel process, comprising means for transporting the magnetic recording medium, a moving abrasive belt serving as the abrasive member which is guided over the surface of the magnetic coating, and a pressure member arranged above the said belt and movable relative to the magnetic coating surface.

Magnetic recording media are produced by coating rigid or flexible substrates, e.g. aluminum disks and webs of thin plastics base material, with a dispersion of magnetic particles, particularly iron oxide particles, in a binder. The surface irregularities formed during the coating operation must be removed carefully in view of the thinness of the magnetic coating, the aim being to achieve a very slight specific microscopic roughness.

This polishing step is necessary to ensure intimate contact between the recording layer surface and the magnetic head or to produce a steady, undisturbed flying attitude in the case of flying heads used in disk memories for instance. As a result, damage to the coating surface during writing or reading, caused for example by the write/read head making contact with the disk or removing portions of the recording layer at particles projecting from the surface, is avoided, particularly in the case of flexible recording disks, and very small fluctuations in the read voltage are achieved.

A method frequently used for improving the surface finish of flexible recording media is calendering in which webs of plastics substrate material, either coated or uncoated, are passed between two rotating rollers that are pressed together with a specific force. In calendering, the web is usually transported in the longitudinal direction. Slight irregularities in the surfaces of the rollers therefore impair the output signal level and may result in dropouts.

For the surface treatment of flexible and rigid magnetic disks or flexible recording media, such as webs of coated base material, abrasive elements, e.g. ceramic cylinders (U.S. Pat. No. 3,943,666) and abrasive belts (U.S. Pat. No. 4,254,585) are employed. In the case of flexible disks, a rotatable circular platen is employed, with which the disk is disposed in torque-transmitting communication via a resilient layer or clamping means secured to the shaft bearing the platen. The ceramic cylinder rotates in the opposite direction to the disk and is urged against it. When an abrasive belt is used, biassing means are provided, by means of which the abrasive belt is pressed against the surface to be treated, the belt being slowly transported in the opposite direction to the coated web. The burnishing action is due partly to the pressure with which the abrasive element bears against the surface to be treated and partly to the abrasiveness of the abrasive element. Ceramic cylinders have a relatively short useful life because the abraded magnetic material wears out the ceramic material and also tends to build up therein, as a result of which the cylinders become less and less effective in the course of time. It has also been found that a pattern-free surface cannot be obtained with ceramic cylinders or abrasive belts. Although adequate microscopic roughness values can be achieved therewith, they are not capable of eliminating the macroscopic roughness. The demands that are made on the output signal level and the signal-to-noise ratio can therefore not be satisfied by these burnishing methods.

Apart from the expense involved, the calendering step, which is usually carried out in the case of webs of substrate material provided with a magnetic coating, is a further source of errors. However, with the burnishing methods used hitherto calendering cannot be dispensed with because magnetic recording media having an acceptably long life and an acceptable output signal level cannot otherwise be obtained.

It is therefore an object of the invention to provide a process for carrying out such process, with which the surface finish and hence the recording properties of magnetic recording media can be improved, without there being any need to carry out the usual calendering step.

This object is achieved by increasing the pressure with which the abrasive member is applied during the burnishing operation, up to a maximum value over a period of time or at a plurality of locations, and then reducing the pressure again, the increase in the applied pressure being linked to a decrease in the abrasiveness of the abrasive member. For carrying out the novel process there is provided an apparatus of the type described at the outset, wherein, according to the invention, the holder for the pressure member is connected to positioning means.

In a variant of the method according to the invention, intended for the surface treatment of a web of coated substrate material which can be fed from a supply roll to a take-up roll, the abrasive belt is guided along the said web from a feed roll to a take-up roll, and a plurality of pressure members, arranged one behind the other in the direction of web travel, are provided which are each connected to positioning means via a holder, and serve to urge the abrasive belt against the coated web.

The procedural steps complementing one another—namely removal of material at a low contact pressure, and subsequent smoothing of the surface, at a much higher contact pressure, with the abrasive belt which has meanwhile loaded up with abraded material and is consequently less abrasive, thermal effects also coming into play—give a consolidated coating having a very smooth surface, without prior calendering of the web of recording medium. All protruding agglomerates and high spots in the coating are removed by the burnishing process. It has been found that, as compared with magnetic recording media produced in the conventional manner, media burnished in this novel way not only exhibit a much lower number of errors in data recording but also have a substantially longer life and distinctly improved recording properties. Moreover, constant product quality is ensured by virtue of the fact that, when the applied pressure is increased over a period of time, burnishing is always commenced with an unused section of the abrasive belt, and that, when the pressure is increased at a plurality of locations, the feed rate of the abrasive belt is constant.

Figure 2:
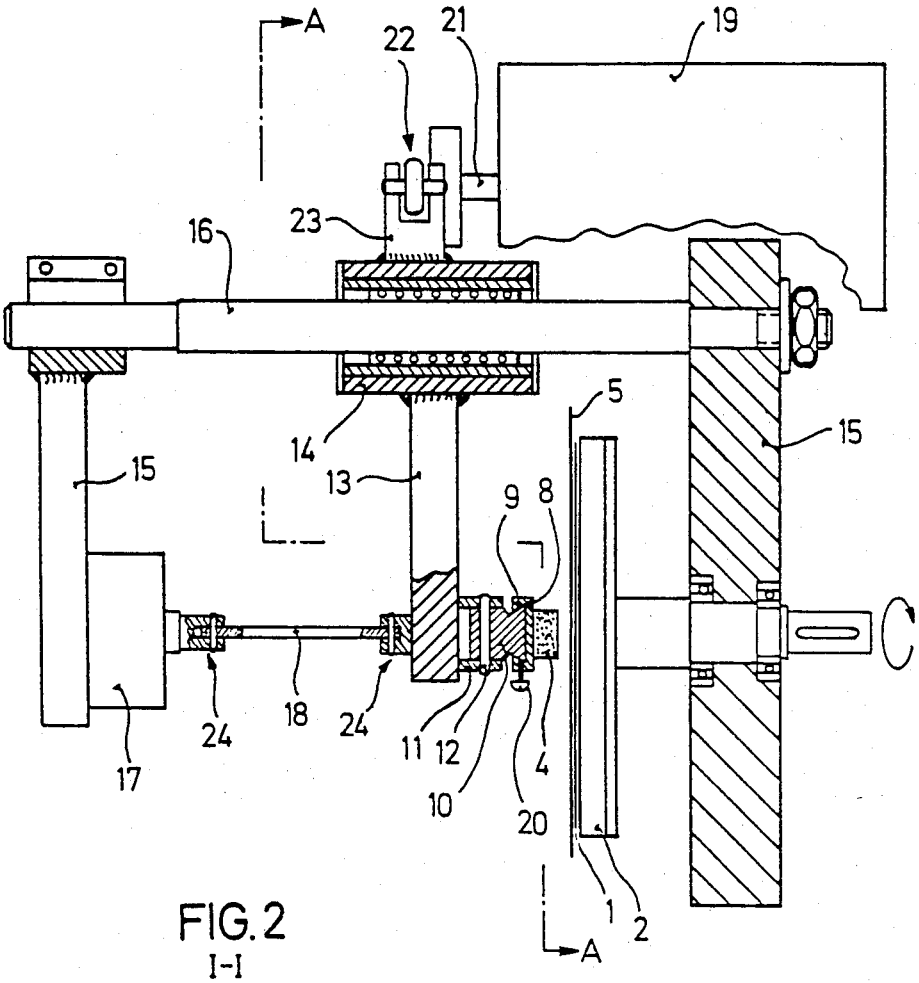
Figure 3:
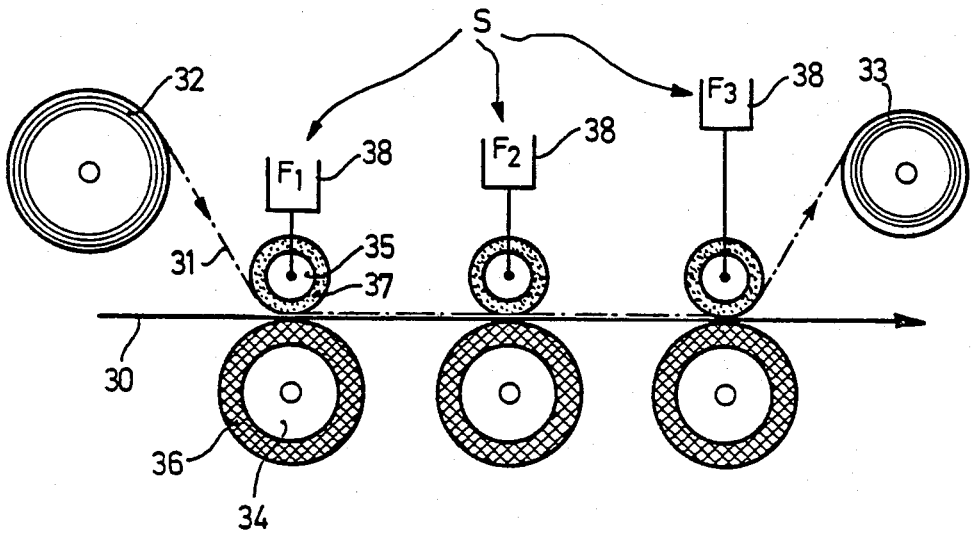
Figure 4:
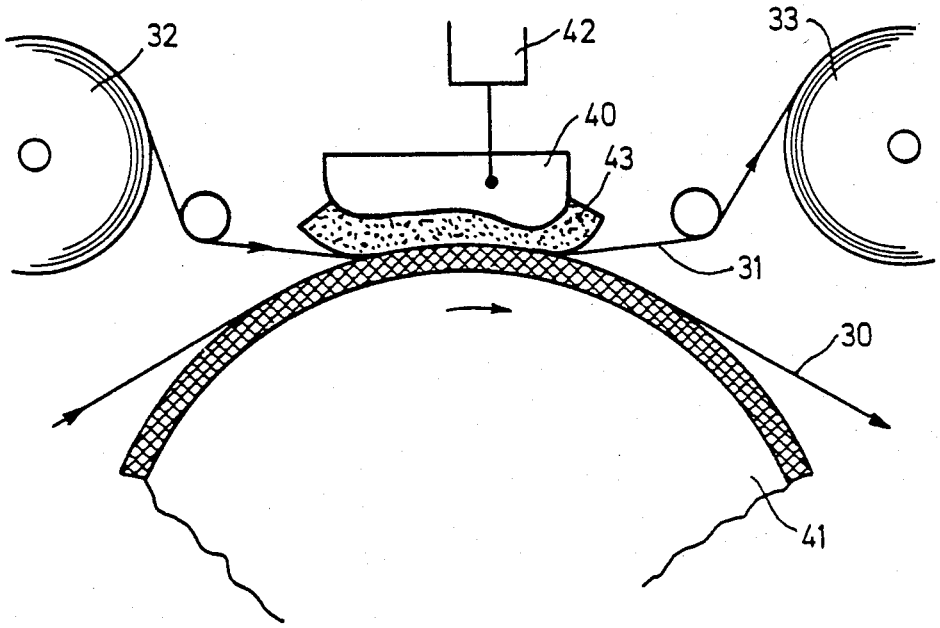

Further details and advantages of the invention are disclosed in the following description of the embodiments illustrated in the accompanying drawings, in which FIG. 1 is a schematic plan view of a first embodiment of the invention for burnishing a flexible magnetic recording disk with an abrasive belt, FIG. 2 is a schematic partial sectional view of the embodiment of FIG. 1 taken along line I—I, FIG. 3 is a schematic side view of a second embodiment of the invention for burnishing a web of coated substrate material, comprising an abrasive belt and pressure rolls, and FIG. 4 illustrates a variant of the embodiment of FIG. 3, employing a pressure bar instead of pressure rolls.

Referring to FIGS. 1 and 2, a turntable 2 which can be driven by a motor (not shown in the drawings) is provided for receiving a flexible disk-shaped recording medium, hereinafter referred to as disk 1 for short. A resilient layer 3 is mounted on the turntable to transmit rotational torque to disk 1 lying thereon, and to absorb irregularities in the lower surface of the disk, e.g. dust particles and other protrusions. Above the turntable there is arranged a pressure member 4 made of sponge rubber or a similar material which extends over essentially the entire width of the disk in contact with the support surface of the turntable, and serves to urge an abrasive belt 5, running across the turntable, against the surface to be burnished, which belt can be transported from a feed roll to a take-up roll and is stationary while it is being pressed against the disk. The pressure member 4 is trapezoidal in shape with the shortest parallel side facing the axis of rotation of the turntable, and is fastened to a holder 8 which is displaceably mounted on a bar 10 by means of a dovetail joint so that it can be moved along a radius of the turntable, and which can be fixed in position with a screw 20. To enable bar 10 to pivot, a bolt 12, held in supports 11, is provided which passes through the bar at right angles to its longitudinal extent. The supports 11 are attached to an arm 13 which is mounted, via a ball-bearing bushing 14, on a shaft 16 borne by the chassis 15, so that it can be displaced perpendicular to the support surface of the turntable and pivoted parallel thereto.

The abrasive belt 5 is urged against the disk surface to be burnished, via the pressure member 4, by means of a piston/cylinder assembly 17 which is mounted on the chassis 15 and is connected to arm 13 via a rod 18. At the beginning of the burnishing operation the pressure applied is set by the said assembly 17 at about 0.2 bar which is raised to about 2 bar in the course of about 8 seconds and, after about a further second has elapsed, is lowered to zero. The speed of the turntable is preferably from 100 to 500 rpm. To effect uniform burnishing of the disk surface, it is advantageous to cause the pressure member 4 to oscillate radially across the turntable at a frequency of 1 to 5 hertz. An electric motor 19 is provided for this purpose, the shaft 21 of which is hingedly connected, via an eccentric rod 22, to a lever 23 attached to the sleeve of the bushing 14. Owing to the fact that arm 13 is movable in the two directions which are at right angles to one another, rod 18 is connected to piston/cylinder assembly 17 and arm 13 via suitable hinges 24; rod 22 is provided with similar hinges 25 and is slidably mounted on the pivots for axial displacement thereon.

The above-described embodiment is of course not the only possible one. It will be understood by the skilled artisan that other designs can be readily conceived by him within the framework of the invention, using the means at his disposal. For example, supports 11 for bar 10 carrying pressure member holder 8 can be slidably mounted in arm 13 so that they can be displaced by piston/cylinder assembly 17 via rod 18, in which case arm 13 need only be pivotally mounted. Assembly 17 can also be so arranged that it acts directly on the sleeve of the bushing 14 or displaces shaft 16 on which the bushing would then be mounted in a fixed position. Another possibility is to so mount the turntable that it can be displaced axially by means of a piston/cylinder assembly.

Referring now to FIG. 3, a plurality of burnishing stations S are provided for the surface treatment of a web-like recording medium, hereinafter referred to as web 30 for short, the stations S being arranged one behind the other in the direction of web travel. The supply and take-up rolls are not shown in the drawing. Here again, an abrasive belt 31 which is transported from a feed roll to a take-up roll serves as the abrasive member, the belt being common to all stations S. The abrasive belt moves at a much lower rate than the web, the ratio of the speed of the belt to that of the web being for example from (1 to 20):100, preferably 1:50. It is however also possible to provide each burnishing station S with an abrasive belt having its own feed and take-up rolls, the abrasive action of the belts advantageously decreasing from station to station in the direction of web travel; in this particular embodiment, the speed of the abrasive belts may also be higher than that of the surface to be treated. When a new feed roll is inserted, a running-in operation should be carried out.

The burnishing stations S each consist of a drivable backing roller 34 for the web 30 and a pressure roll 35 for urging the abrasive belt against the web. The backing rollers and pressure rolls are provided with resilient peripheral portions 36 and 37 respectively; for example, sponge rubber can be used in the case of the pressure rolls, and soft rubber or polyurethane foam in the case of the backing roller. The pressure rolls are rotatably mounted in holding means on which pneumatic or hydraulic piston/cylinder assemblies 38 act. The applied pressures $F_{1-3}$ increase in the direction of web travel; for example, in the case of an apparatus having three burnishing stations, the pressures are 0.4, 0.8 and 1.6 bar respectively. For the sake of simplification, the drive for the backing rollers is not illustrated in the drawing, and the holding means for the pressure rolls 35, and the piston/cylinder assemblies 38 are only shown in a general manner. Here again, drive means as shown in FIGS. 1 and 2 (19–23), which act on the holding means for the pressure rolls, can be provided to oscillate the pressure rolls transversely to the direction of web travel.

In a further advantageous embodiment shown in FIG. 4, the abrasive belt 31 running over web 30 is pressed against its surface by means of a pressure bar 40 which extends over the entire width of the web. In this region the web 30 is guided over a backing roller 41. The pressure bar is connected to one or more piston/cylinder assemblies 42; if two or more assemblies are employed, they are distributed evenly over the width of the web. The profile of the pressure bar 40, provided with a resilient pad 43, is such that the lower surface of the bar draws closer to the backing roller in the direction of web travel, so that the pressure per unit area increases. During the application of pressure, the abrasive belt moves at a slower rate than the web.

We claim:

1. A method of treating the surface of magnetic recording media by burnishing, comprising: applying relative movement between the surface to be burnished and an abrasive member, pressing the abrasive member against the said surface, commencing with an unused portion of said abrasive member against a portion of said surface and controlling the pressure with which the said abrasive member portion is applied to said portion of said surface during the burnishing operation by burnishing at a lower burnishing pressure and then increasing from said one pressure up to a maximum burnishing pressure as the abrasive member portion in contact with the surface said portion of surface becomes loaded with abraded material from said surface and then reducing to less than the maximum pressure, and wherein the increase in the applied pressure occurs with a decrease in the abrasiveness of the abrasive member.

2. A method as claimed in claim 1, wherein a pressure member at the location at which the abrasive member is pressed against the surface to be burnished is oscillated transversely to the direction of relative movement during the burnishing operation.

3. The method as claimed in claim 2, wherein the magnetic recording media is a disk which is rotated at a speed of 100 to 500 rpm, and the abrasive member is a belt incrementally moved from a feed roll to a take-up roll and pressed in a trapezoidal area against the surface of said disk commencing at a pressure of about 0.2 bar and increased gradually to about 2.0 bar over a period of about eight seconds.

4. The method as claimed in claim 1, wherein the magnetic recording media is a web moved continuously in one direction and the abrasive member is a belt continuously moved in said direction from a feed roll to a take-up roll at a speed different from the web speed so as to maintain relative movement between said web and said belt and whereby any given portion of said web surface is first contacted by an unused portion of the abrasive belt at a relatively lower pressure and later contacted by a used portion of said abrasive belt at a higher pressure.

* * * * *